US007003807B2

(12) United States Patent
Takanohashi

(10) Patent No.: US 7,003,807 B2
(45) Date of Patent: Feb. 28, 2006

(54) CAP FOR PERMANENT WAVES

(76) Inventor: Toshiko Takanohashi, 6-76, Nakajima aza maego, Shiwa-cho, Shiwa-gun, Iwate (JP) 028-3301

( * ) Notice: Subject to any disclaimer, the term of this patent is extended or adjusted under 35 U.S.C. 154(b) by 249 days.

(21) Appl. No.: 10/431,146

(22) Filed: May 6, 2003

(65) Prior Publication Data

US 2004/0221369 A1 Nov. 11, 2004

(51) Int. Cl.
*A42B 1/18* (2006.01)

(52) U.S. Cl. ..... 2/174

(58) Field of Classification Search ..... 2/171, 2/171.2, 174, 171.5, 171.8, 172, 206, 207, 2/9, 204, 200.1, 200.2; 132/270, 274
See application file for complete search history.

(56) References Cited

U.S. PATENT DOCUMENTS 2,336,356 A * 12/1943 Harding ..... 2/204
2,665,427 A * 1/1954 Street et al. ..... 2/195.7
4,462,117 A * 7/1984 Brunelle ..... 2/202
5,365,613 A 11/1994 Henegan
5,621,919 A * 4/1997 Graham ..... 2/174
6,560,784 B1 * 5/2003 Hill ..... 2/171

FOREIGN PATENT DOCUMENTS

JP 48001 4/1990
JP 10-155537 6/1998

* cited by examiner

*Primary Examiner*—Gary L. Welch
(74) *Attorney, Agent, or Firm*—Intellectual Property Law Group LLP; Otto O. Lee; Juneko Jackson

(57) ABSTRACT

Rings 5 of the shearing rubber are sewn with eight points at the surfaces and rear sides at both ends of the left turban 1 and right turban 2. The turban stopper 4 can be passed through the eight points between the ring-shaped outer circumference 8 and the ring-shaped inner circumference 9. The shearing rubber 10 is sewn with the ring-shaped outer circumference 8 and ring-shaped inner circumference 9, corresponding to the four sides, left and right, and diagonally from the center of the central line of the cap body 3 made of thin polyamide-Japanese paper blended material. Both the left turban 1 and the right turban 2 are formed by wrapping a thin towel with thin polyamide-Japanese paper blended material wherein, the cap body, left turban and right turban are integrated and are reversible types by which the surface and rear side thereof can be used. Two steps of work for application of permanent treatment solutions can be rationally carried out with only one cap for permanent waves comfortably.

10 Claims, 7 Drawing Sheets

CAP FOR PERMANENT WAVES

BACKGROUND OF THE INVENTION

1. Technical Field of the Invention

The present invention relates to a cap for permanent waves, which, when a cold permanent is carried out, prevents a permanent treatment solution from flowing down onto the forehead, cheeks, back of the neck, clothes, etc., below the headline.

2. Prior Art

A prior art cap for permanent waves is made of a polyethylene or polyvinyl material, the cap, towel and turban are separately used, and raw rubber is sewn with the ring-shaped outer circumference that is the lower end edge of an opening portion of the cap for permanent waves.

In the prior art cap for permanent waves, towels and turbans are separately used when applying a permanent treatment solution. Therefore, this is not so easy to operate. In addition, since the cap is made of a polyethylene or polyvinyl material, the ventilation thereof is bad, wherein even if these are washed with a detergent after the permanent treatment solution is used, immersed in an antiseptic solution, and dried, a chemical reaction occurs between the antiseptic solution and polyvinyl material, thereby causing an odor, and when they are re-used, the chemical reaction becomes a cause for dermatosis.

Also, raw rubber is used on the ring-shaped outer circumference that is the lower end edge of the opening portion of the prior art cap for permanent waves, and a permanent treatment solution is accumulated around the raw rubber when the cap is mounted. The permanent treatment solution is combined with the raw rubber, whereby the raw rubber is rotted and cut off, and odors arise. In addition, the prior art cap for permanent waves is excessively large and does not securely fit a head portion.

Further, since the material of the prior art towels and turbans is excessively thick, it is hardened if it is mixed with a permanent treatment solution. Dermatosis is likely to occur. In addition, adhesion of the towels and/or turbans to skin is not sufficient, wherein a permanent treatment solution is liable to flow onto the forehead, cheeks, back of the neck, clothes, etc., below the headline.

SUMMARY OF THE INVENTION

In order to solve the above-described object, a cap for permanent waves according to an embodiment of the invention includes a cap body for covering up the head portion, and two band-shaped turbans, wherein the central side edges of the turbans are sewn with the positions opposed to the lower end edge of an opening portion of said cap body.

At the cap body, shearing rubber is sewn with a ring-shaped outer circumference which is the lower end edge of the opening portion, and a ring-shaped inner circumference which is formed at a position higher by the width of said turbans than said ring-shaped outer circumference.

Further, the cap body is made of thin polyamide-Japanese paper blended material.

In addition, the cap body is provided with a turban stopper, whose upper and lower ends are sewn with said ring-shaped outer circumference and said ring-shaped inner circumference so that the turban is inserted thereinto, at least on the surface or rear side of the positions with which the turban is sewn.

Further, the turban stopper is made of thin polyamide-Japanese paper blended material, and is provided in four or more directions of dividing said cap body into at least four equal sections.

Still further, a shearing rubber ring is sewn with the surface and rear side at both ends of said turban at one-fourth length thereof.

Also, the turban is formed by wrapping a thin towel with thin polyamide-Japanese paper blended material.

As described above, since, in the embodiment of the present invention, the cap body, left turban and right turban are integrated and are reversible types by which the surface and rear side thereof can be used. Two work steps for application of permanent treatment solutions can be rationally carried out with only one cap for permanent waves without providing any discomfort.

Since the cap body is made of thin polyamide-Japanese paper blended material, ventilation thereof is satisfactory, and cost thereof is inexpensive. The cap body may be disposable.

Since, at the cap body, shearing rubber is sewn with the ring-shaped outer circumference and ring-shaped inner circumference by using a locking sewing machine, the cap body can be securely fitted to the entire head.

Also, since the shearing rubber is used, it is difficult to become corrupt even if it is combined with permanent treatment solutions. Therefore, odors can be prevented from being generated.

Since the turban stopper is attached to the surface and rear side of the cap body at eight points, the turban which is not used is protected, housed and fixed so that it is not stained by permanent treatment solutions, the turban does not hinder work, and working efficiency is improved.

Also, since the left turban and right turban are made of thin towels and thin Japanese paper, the turbans are not hardened even if the turbans are combined with permanent treatment solutions, wherein dermatosis is prevented. Further, adhesion of the turbans to skin is increased, wherein permanent treatment solutions are prevented from flowing down on the forehead, cheeks, back of the neck, clothes, etc., below the headline, and at the same time, ventilation is satisfactory, the cost thereof is inexpensive. Therefore, the turbans may be disposable.

Since rings of the shearing rubber are sewn at eight points of both ends, surface and rear side of the left turban and the right turban, etc., a ring of the shearing rubber, which is at any position, may be wound on the left turban or right turban in order to cross and fix both ends of the left turban or the right turban at the forehead. This is very rational.

DETAILED DESCRIPTION OF SPECIFIC EMBODIMENTS

Hereinafter, a description is given of an embodiment of the invention with reference to the accompanying drawings.

Figure 13:
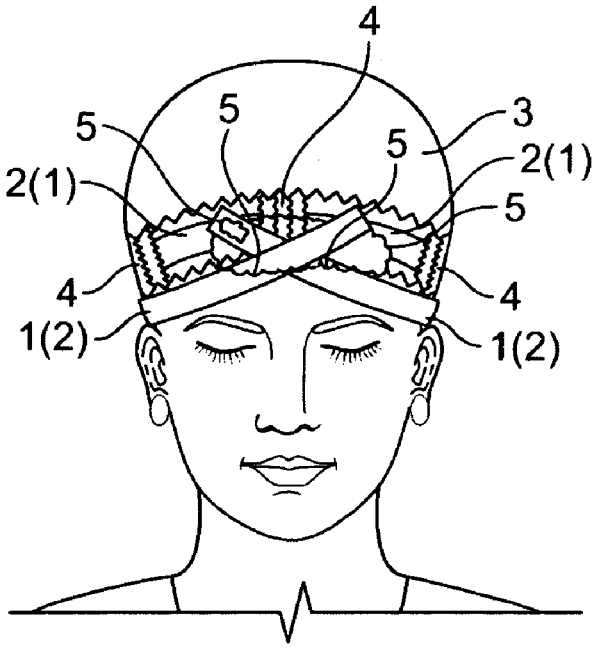
FIG. 13 is a front elevational view showing a use state where an embodiment of the invention is completed.
Figure 14:
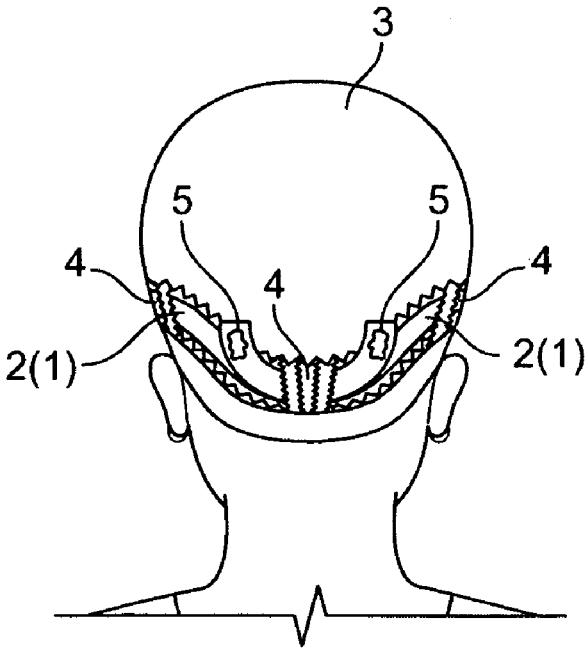
FIG. 14 is a rear side view showing a use state when an embodiment of the invention is completed.

A cap for permanent waves according to an embodiment of the invention is used as shown in FIG. 13 and FIG. 14, which includes a cap body 3 for covering up the entire head portion, a left band-shaped turban 1 and a right band-shaped turban 2.

Figure 1A:
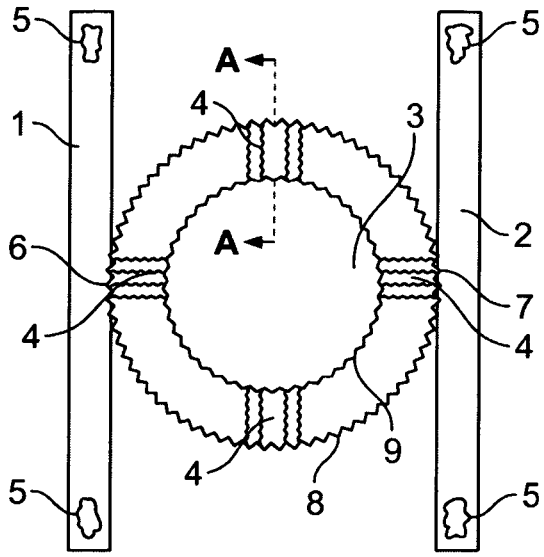
FIG. 1(*a*) is a plan view of a cap for permanent waves according to an embodiment of the invention, and FIG. 1(*b*) is a sectional view taken along the line A—A of FIG. 1(*a*)
Figure 1B:
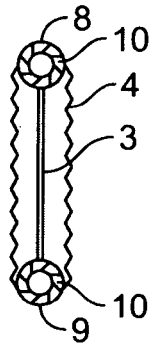

The above-described cap body 3, left turban 1 and right turban 2 are, respectively, integrated as shown in a plan view of FIG. 1(*a*), so that the ring-shaped outer circumference 8 of the lower end edge of the opening portion of the cap body 3 at the left side from the central line of the drawing and a connection portion 6 at the central end of the left turban are sewn together by using a locking sewing machine, and the ring-shaped outer circumference 8 of the lower end edge of the opening portion of the cap body 3 at the right side from the central line of the drawing and a connection portion 7 at the central end of the right turban are sewn together by using a locking sewing machine.

Further, at the above-described cap body 3, shearing rubber 10 is sewn with the ring-shaped outer circumference 8 that is the lower end edge of the opening, and the ring-shaped inner circumference 9 formed at a position higher by the width of the turban than the ring-shaped outer circumference 8.

Since the shearing rubber 10 is sewn with the ring-shaped outer circumference 8 and ring-shaped inner circumference 9 of the cap body 3 by using a locking sewing machine, the cap body 3 can be completely fitted to the head portion.

Figure 2A:
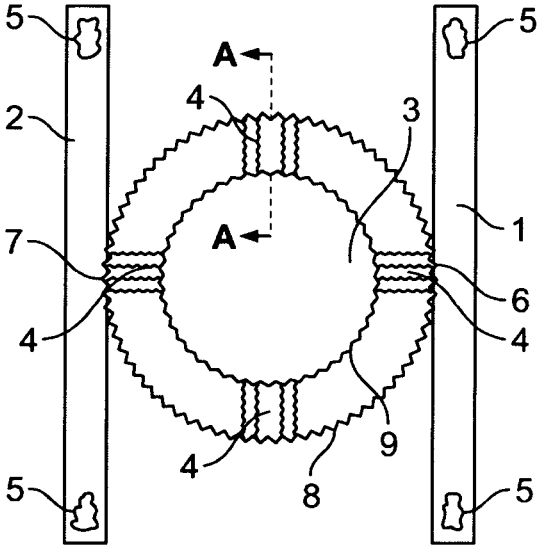
FIG. 2(*a*) is a bottom view showing a state where the cap for permanent waves according to an embodiment of the invention is turned upside down, and FIG. 2(*b*) is a sectional view taken along the line A—A of FIG. 2(*a*)
Figure 2B:
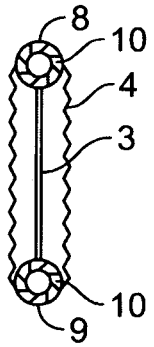

Also, as shown in the bottom view of FIG. 2(*a*), which is obtained by turning the state shown in FIG. 1(*a*) upside down, the entire configuration is identical to the above-described state except that the convex and concave of the head portion of the cap body 3 and the turbans are inversely oriented.

As shown in FIG. 1(*a*) and FIG. 2(*a*), rings 5 of the shearing rubber 10 are sewn by one-fourth thereof with eight points at the surfaces and rear sides at both ends of the left turban 1 and right turban 2.

Figure 8:
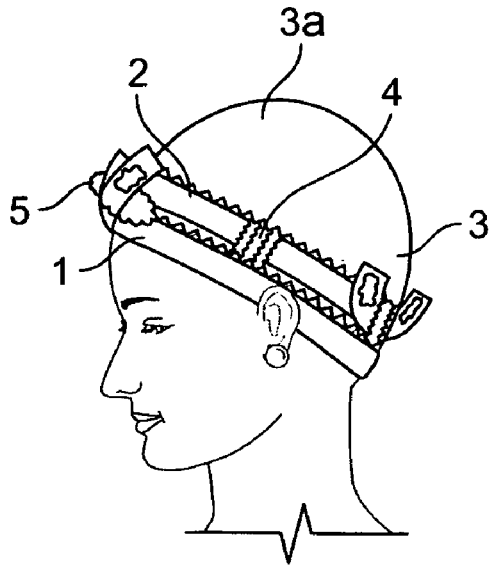
FIG. 8 is a view showing a use state where a cap body according to an embodiment of the invention is placed.

As shown in FIG. 8, the rings 5 of the shearing rubber 10 are used to cross both ends of the left turban 1 or right turban 2 at the hair line of the forehead, and wind and fix the crossed portions by the rings 5.

Figure 3A:
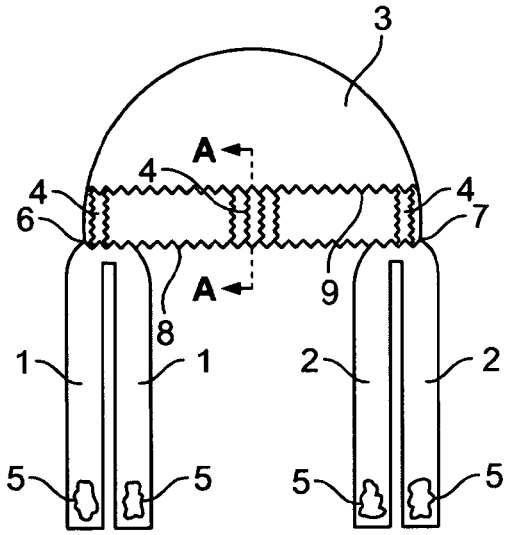
FIG. 3(*a*) is a left side view of a cap for permanent waves according to an embodiment of the invention, and FIG. 3(*b*) is a sectional view taken along the line A—A of FIG. 3(*a*)
Figure 3B:
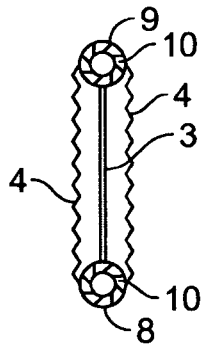
Figure 4A:
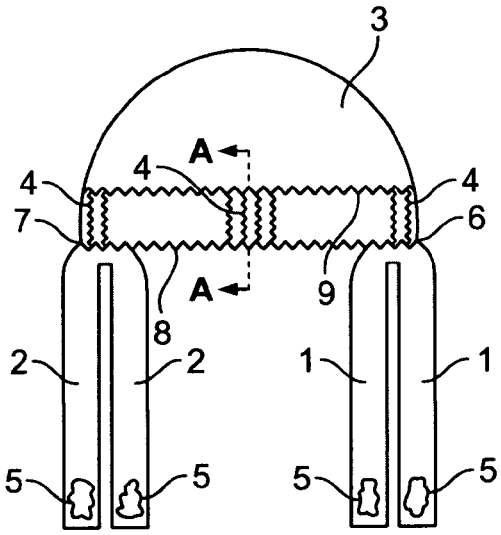
FIG. 4(*a*) is a right side view of a cap for permanent waves according to an embodiment of the invention, and FIG. 4(*b*) is a sectional view taken along the A—A of FIG. 4(*a*)
Figure 4B:
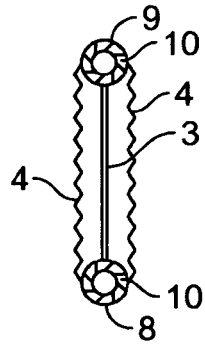

The turban stopper 4 is made of thin polyamide-Japanese paper blended material and has upper and lower ends sewn so that, as shown in FIG. 3(*a*) and FIG. 4(*a*), the turbans 1 and 2 can be passed through the eight points, as shown in FIG. 3(*b*) and FIG. 4(*b*), between the ring-shaped outer circumference 8 and the ring-shaped inner circumference 9 corresponding to the four sides, left and right, and diagonally from the center of the central line of the cap body 3.

Also, although the turban stoppers 4 are provided in the direction of equally dividing the cap body 3 into four sections in FIG. 3(*a*) and FIG. 4(*a*), the turban stoppers 4 may be provided in the direction of equally dividing the cap body 3 into eight sections.

In addition, the edge of the turban stopper 4 and the inside longitudinal direction are reinforced by sewing two shearing rubbers 10 therewith.

Also, the above-described turban stopper 4 is used to fix and accommodate the left turban 1 or right turban 2, which is not used, after it is passed therethrough, when applying permanent treatment solution No. 1 and permanent treatment solution No. 2.

Figure 5A:
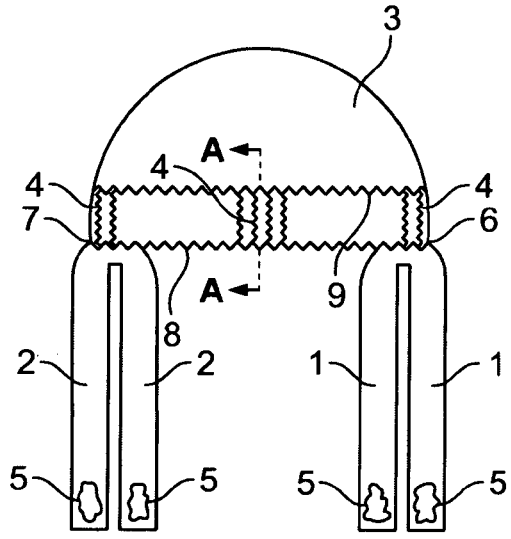
FIG. 5(*a*) is a left side view showing a state where a cap for permanent waves according to an embodiment of the invention is turned upside down, and FIG. 5(*b*) is a sectional view taken along the line A—A of FIG. 5(*a*)
Figure 5B:
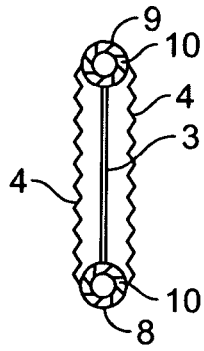
Figure 6A:
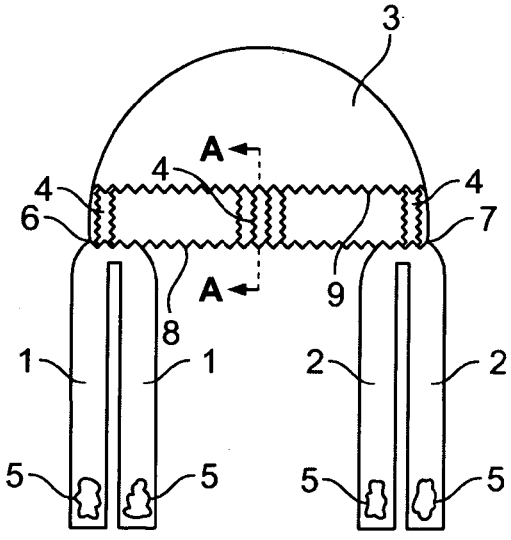
FIG. 6(*a*) is a right side view showing a state where a cap for permanent waves according to an embodiment of the invention is turned upside down, and FIG. 6(*b*) is a sectional view taken along the line A—A of FIG. 6(*a*)
Figure 6B:
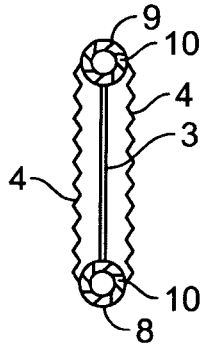

As shown in FIG. 5 and FIG. 6 where only the cap body 3 shown in FIG. 3 and FIG. 4 is turned upside down, in a state where the cap body 3 is turned upside down, the entire configuration is identical to the above-described state except that the turbans are inversely oriented.

Next, a description is given of a use method of the cap for permanent waves according to an embodiment of the invention with reference to the accompanying drawings.

Figure 7:
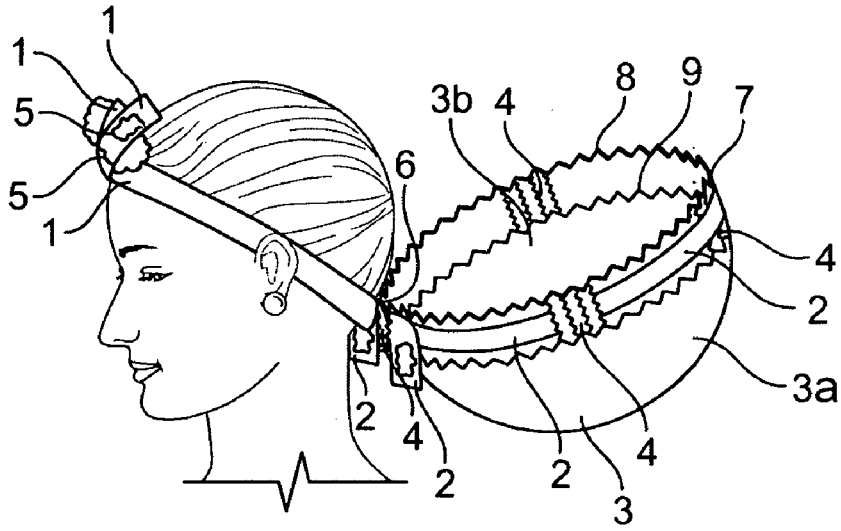
FIG. 7 is a view showing a use state where a turban 1 according to an embodiment of the invention is wound.

In FIG. 7, the ring-shaped outer circumference 8 and the connection portion 6 at the central edge of the right turban are fitted to the hairline of the occipital region, and both ends of the left turban 1 are crossed at the hairline portion of the forehead while causing the left turban 1 to be adhered to the hairline at the left and right side of the head portion around the above-described connection portion 6, the end portion of the turban 1 at one end is wound by the ring 5 of the shearing rubber 10 of the turban 1 at the other end, wherein both turbans are firmly fixed, and the left turban 1 is adhered to the hairline (headline) of the entire head portion.

By firmly winding the turban, the turban itself can be fitted to the entire headline at the hairline.

For simplifying a description in the state shown in FIG. 7, hereinafter, the outside surface is made into 3*a*, and the inside rear side is made into 3*b*.

Also, the right turban 2 that is not used is passed through the turban stopper 4 attached to the surface 3*a* of the cap body 3 centering around the ring-shaped outer circumference 8 and the connection portion 7 at the central portion of the left turban, and both ends of the right turban 2 are crossed and inserted into the turban stopper 4 of the occipital region, and are pressed and fixed by the turban stopper 4.

Therefore, it is possible to prevent the right turban 2 that is not used from becoming an obstacle with respect to proceeding with permanent work, and from being stained by permanent treatment solution No. 1.

In this state, since permanent treatment solution No. 1 is applied on the entire head, there is no case where the permanent treatment solution flows down on the forehead, cheeks, back of the neck, clothes, etc., below the headline.

When applying permanent treatment solution No. 1, the left turban 1 shown in FIG. 7 and the rear side 3*b* of the cap body 3 are used, and at this time, the surface 3*a* of the cap body 3 and the right turban 2 are not stained by the permanent treatment solution No. 1.

Thus, as application of the permanent treatment solution No. 1 is finished, the cap body 3 is covered up on the head portion.

FIG. 8 shows a state where the cap body 3 shown in FIG. 7 is placed on the entire head portion and is adhered to the left turban 1.

After a prescribed period of time elapses, the turban 2 is removed from the turban stopper 4, and the cap body 3 is removed from the head portion.

Figure 9:
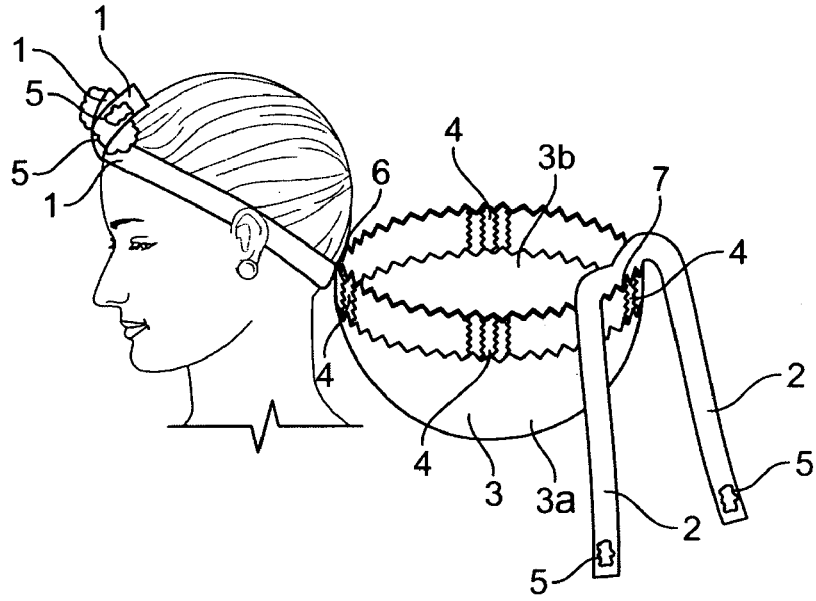
FIG. 9 is a view showing a use state where a cap body according to an embodiment of the invention is removed.

FIG. 9 shows a state where the cap body 3 is opened from the state shown in FIG. 8 and the right turban 2 is removed from the turban stopper 4.

Next, in such a state, the cap body 3 is turned upside down, so that the surface 3*a* thereof is turned into the inside, and the rear side 3*b* is turned into the outside.

Figure 10:
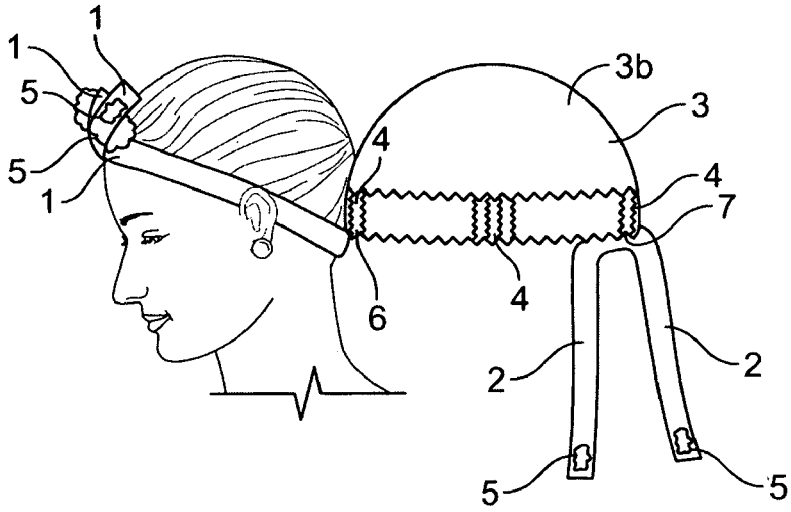
FIG. 10 is a view showing a use state where a cap body according to an embodiment of the invention is turned upside down.

FIG. 10 shows a state where the cap body 3 shown in FIG. 9 is turned upside down, that is, the surface 3*a* of the cap body 3 is turned into the inside and the rear side 3*b* thereof is turned into the outside.

Further, the surface 3*a* inside the cap body 3 is in a state where it is not stained by the permanent treatment solution No. 1 at all.

Figure 11:
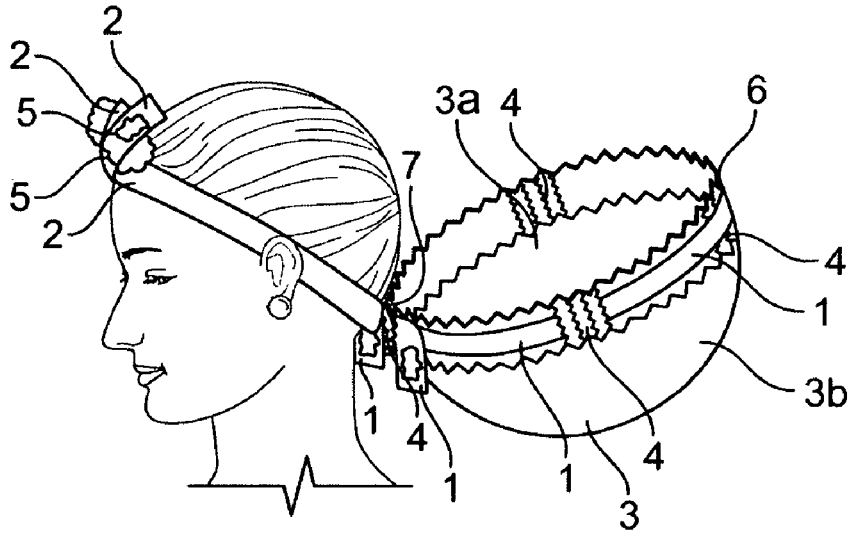
FIG. 11 is a view showing a use state where a turban 2 according to and embodiment of the invention is wound.

And, after the turban 1 is released, and the cap body 3 is removed from the head portion, the ring-shaped outer circumference 8 and the connection portion 7 of the central edge of the left turban are fitted to the hairline of the occipital region as shown in FIG. 11 in the inverted procedure of mounting when applying permanent treatment solution No. 1 in FIG. 7, and both ends of the right turban 2 are crossed at the hairline of the forehead while causing the right turban 2 to adhere to the left and right hairlines of the head portion centering around the above-described connection portion 7. Further, both ends of the right turban 2 are wound by the ring 5 of the shearing rubber, whereby the right turban 2 is firmly fixed to cause the right turban 2 and the headline at the hairline of the entire head portion to adhere to each other.

At this time, the left turban 1 which is stained by permanent treatment solution No. 1 is passed through the left and right turban stopper 4 attached to the outer rear side 3*b* of the cap body 3, and both ends of the left turban 1 are crossed and passed through the turban stopper 4 at the occipital region. Then, the left turban 1 is pressed and fixed by the turban stopper 4.

In such a state, permanent treatment solution No. 2 is applied to the entire head.

When applying permanent treatment solution No. 2, the right turban 2 shown in FIG. 11 and the inside surface 3*a* of the cap body 3 are used.

Thus, after the application of permanent treatment solution No. 2 is finished, the cap body 3 is covered up on the head portion.

Figure 12:
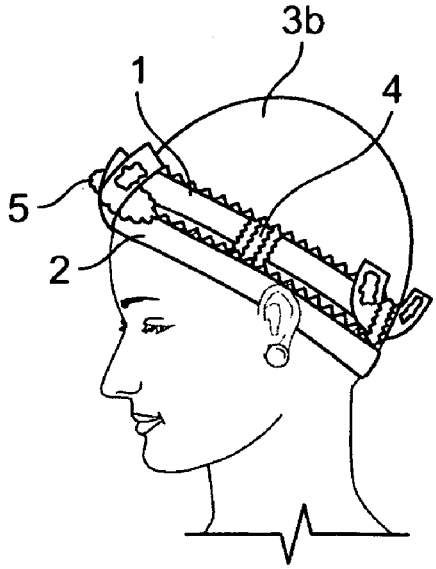
FIG. 12 is a view showing a use state where a cap body according to an embodiment of the invention is placed.

FIG. 12 shows a state where the cap body 3 in FIG. 11 is placed on the entire head portion and is adhered to the right turban 2.

FIG. 13 is a front elevational view of FIG. 8 and FIG. 12. A beautician may use either one of rings 5 of the shearing rubber 10, which are attached to both ends, surface and rear side of the left turban 1 or right turban 2, depending on whether the beautician is a left-handed person or right-handed person.

FIG. 14 is a rear side view of FIG. 8 and FIG. 12. Both ends of the left turban 1 or right turban 2, which are not used, are crossed and passed through the turban stopper 4 on the rear side, and pressed and fixed by the turban stopper 4.

As described above, the cap is a reversible type by which the surface 3*a* and rear side 3*b* of the cap body 3, and two turbans which are the left turban 1 and right turban 2 may be used.

Also, the left turban 1 and right turban 2 are also a reversible type by which the surface and rear side may be used.

What is claimed is:

1. A cap for permanent waves, comprising: a cap body for covering up a head portion; and two band-shaped turbans capable of being firmly fixed to a hairline of the entire head portion and preventing permanent treatment solution from flowing past the hairline, wherein a central side edge near a midpoint along a longest side edge of each of said turbans are sewn respectively at positions opposed to a lower end edge of an opening portion of said cap body.

2. The cap for permanent waves as set forth in claim 1, wherein, at said cap body, a shearing rubber is sewn with a ring-shaped outer circumference which is the lower end edge of the opening portion, and a ring-shaped inner circumference which is formed at a position higher, by a width of said turbans, than said ring-shaped outer circumference.

3. The cap for permanent waves as set forth in claim 2, wherein said cap body is made of a thin polyamide-Japanese paper blended material, said blended material textured by polyamide fibers and Japanese paper fibers.

4. A cap for permanent waves as set forth in any one of claims 2 and 3, wherein said cap body is provided with at least one turban stopper, having upper and lower ends which are sewn with said ring-shaped outer circumference and said ring-shaped inner circumference so that at least one of said turbans is inserted thereinto, at least on a surface and a rear side of the positions with which said turban is sewn.

5. The cap for permanent waves as set forth in claim 4, wherein said turban stopper is made of a thin polyamide-Japanese paper blended material, said blended material textured by polyamide fibers and Japanese paper fibers, and is provided in four or more directions of dividing said cap body into at least four equal sections.

6. The cap for permanent waves as set forth in claim 1, wherein a shearing rubber ring is sewn with a surface and a rear side at both ends of said turban at one-fourth length thereof.

7. A cap for permanent waves as set forth in claim 1 or 6, wherein said turban is formed by wrapping a thin towel with thin polyamide-Japanese paper blended material, said blended material textured by polyamide fibers and Japanese paper fibers.

8. The cap for permanent waves as set forth in claim 1, wherein said cap body is made of a thin polyamide-Japanese paper blended material, said blended material textured by polyamide fibers and Japanese paper fibers.

9. The cap for permanent waves as set forth in claim 8, wherein, at said cap body, a shearing rubber is sewn with a ring-shaped outer circumference which is the lower end edge of the opening portion, and a ring-shaped inner circumference which is formed at a position higher, by a width of said turbans, than said ring-shaped outer circumference, and wherein said cap body is provided with at least one turban stopper, having upper and lower ends which are sewn with said ring-shaped outer circumference and said ring-shaped inner circumference so that at least one of said turbans is inserted thereinto, at least on a surface and a rear side of the positions with which said turban is sewn.

10. The cap for permanent waves as set forth in claim 9, wherein said turban stopper is made of a thin polyamide-Japanese paper blended material, said blended material textured by polyamide fibers and Japanese paper fibers, and is provided in four or more directions of dividing said cap body into at least four equal sections.

* * * * *